US009937392B2

(12) United States Patent
Myers et al.

(10) Patent No.: US 9,937,392 B2
(45) **Date of Patent: *Apr. 10, 2018**

(54) GOLF CLUB HEAD WITH ADJUSTABLE WEIGHT BAR

(71) Applicant: Callaway Golf Company, Carlsbad, CA (US)

(72) Inventors: Matthew Myers, Carlsbad, CA (US); James A. Seluga, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/650,151

(22) Filed: Jul. 14, 2017

(65) Prior Publication Data

US 2017/0312593 A1 Nov. 2, 2017

Related U.S. Application Data

(63) Continuation of application No. 15/292,028, filed on Oct. 12, 2016, now Pat. No. 9,731,175, which is a continuation-in-part of application No. 15/191,207, filed on Jun. 23, 2016, now Pat. No. 9,682,296, which is a continuation-in-part of application No. (Continued)

(51) Int. Cl.
*A63B 53/06* (2015.01)
*A63B 53/04* (2015.01)

(52) U.S. Cl.
CPC ..... *A63B 53/0466* (2013.01); *A63B 53/047* (2013.01); *A63B 53/0487* (2013.01); *A63B 53/065* (2013.01); *A63B 53/06* (2013.01); *A63B 2053/0408* (2013.01); *A63B 2053/0433* (2013.01); *A63B 2053/0491* (2013.01); *A63B 2053/0495* (2013.01)

(58) Field of Classification Search
CPC ..... A63B 53/06; A63B 53/0466; A63B 2053/0408; A63B 2053/0433; A63B 2053/0491
USPC ..... 473/334–339, 341, 344, 345, 349
See application file for complete search history.

(56) References Cited

U.S. PATENT DOCUMENTS 9,211,453 B1 * 12/2015 Foster ..... A63B 53/06
9,731,175 B1 * 8/2017 Myers ..... A63B 53/0466
2010/0331103 A1 * 12/2010 Takahashi ..... A63B 53/0466 473/338

FOREIGN PATENT DOCUMENTS

GB 2327889 A * 2/1999 ..... A63B 53/04

* cited by examiner

*Primary Examiner* — Benjamin Layno
(74) *Attorney, Agent, or Firm* — Rebecca Hanovice; Michael Catania; Sonia Lari

(57) ABSTRACT

A golf club head with means for adjusting a center of gravity along more than one axis is disclosed herein. The golf club head comprises at least one rectangular weight bar disposed within a recessed region on the sole and adjustable within the recessed region. One end of the weight bar is reversibly fixed to the sole with a connection element, while the other end includes an engagement feature that engages a retention feature at the edge of the recessed region. The retention feature provides multiple locations at the edge of the recessed region to which the engagement feature can be fixed, and when the weight bar is in a configuration desired by a golfer, the weight bar can be reversibly secured to the sole and immobilized within the recessed region by tightening the connection element. The weight bar may also include a slidable weight assembly.

20 Claims, 12 Drawing Sheets

Related U.S. Application Data

15/089,043, filed on Apr. 1, 2016, now Pat. No. 9,636,553, which is a continuation-in-part of application No. 14/981,433, filed on Dec. 28, 2015, now Pat. No. 9,375,618, which is a continuation of application No. 14/635,890, filed on Mar. 2, 2015, now Pat. No. 9,220,957, which is a continuation of application No. 14/326,307, filed on Jul. 8, 2014, now Pat. No. 8,968,116, which is a continuation-in-part of application No. 13/766,658, filed on Feb. 13, 2013, now Pat. No. 8,790,195.

(60) Provisional application No. 62/293,247, filed on Feb. 9, 2016, provisional application No. 61/746,348, filed on Dec. 27, 2012.

GOLF CLUB HEAD WITH ADJUSTABLE WEIGHT BAR

CROSS REFERENCES TO RELATED APPLICATIONS

The present application is a continuation of U.S. patent application Ser. No. 15/292,028, filed on Oct. 12, 2016, now U.S. Pat. No. 9,731,175, which is a continuation-in-part of U.S. patent application Ser. No. 15/191,207, filed on Jun. 23, 2016, now U.S. Pat. No. 9,682,296, which is a continuation-in-part of U.S. patent application Ser. No. 15/089,043, filed on Apr. 1, 2016, now U.S. Pat. No. 9,636,553, which claims priority to U.S. Provisional Patent Application No. 62/293,247, filed on Feb. 9, 2016, and is a continuation-in-part of U.S. patent application Ser. No. 14/981,433, filed on Dec. 28, 2015, and issued on Jun. 28, 2016, as U.S. Pat. No. 9,357,618, which is a continuation of U.S. patent application Ser. No. 14/635,890, filed on Mar. 2, 2015, and issued on Dec. 29, 2015, as U.S. Pat. No. 9,220,957, which is a continuation of U.S. patent application Ser. No. 14/326,307, filed on Jul. 8, 2014, and issued on Mar. 3, 2015, as U.S. Pat. No. 8,968,116, which is a continuation-in-part of U.S. patent application Ser. No. 13/766,658, filed on Feb. 13, 2013, and issued on Jul. 29, 2014, as U.S. Pat. No. 8,790,195, which claims priority to U.S. Provisional Patent No. 61/746,348, filed on Dec. 27, 2012, the disclosure of each of which is hereby incorporated by reference in its entirety herein.

STATEMENT REGARDING FEDERALLY SPONSORED RESEARCH OR DEVELOPMENT

Not Applicable

BACKGROUND OF THE INVENTION

Field of the Invention

The present invention relates to a golf club head. More specifically, the present invention relates to a golf club head having a plurality of adjustable features that allow the club head's center of gravity to be moved along multiple axes.

Description of the Related Art

The ability to adjust center of gravity location and weight in the head of golf clubs is useful for controlling performance of the golf club, particularly in wood-type golf clubs such as drivers. The prior art includes several different solutions for adjustable weighting, but these solutions do not optimize weight adjustment because they typically allow for center of gravity (CG) adjustment along only one axis. See, for example, U.S. Pat. Nos. 7,611,424 and 8,016,694. Therefore, there is a need for a weighting mechanism that allows for simple and flexible center of gravity and moment of inertia (MOI) adjustability along more than one axis.

BRIEF SUMMARY OF THE INVENTION

The present invention is a novel way of working with adjustable products. The present invention allows consumers to adjust the center of gravity of a golf club head along both horizontal X (front to rear) and Y (heel to toe) axes without the use of weight screws. The objective of this invention is to provide a plurality of adjustable weighting options with minimal or no effect on appearance at address while maximizing the ability of the weight to adjust center of gravity location.

One aspect of the present invention is a golf club head comprising a body comprising a face, sole, heel side, toe side, and rear side, a weight bar comprising a central region having a first width W1, a first end having a through-bore and a second width W2, a second end having a third width W3, and a hook extending from the second end, and a screw comprising a head portion and a threaded portion, wherein the sole comprises a recessed region, a threaded receiving opening within the recessed region, and a retention feature disposed along an elongated edge of the recessed region, wherein the recessed region is approximately triangular in shape and comprises a vertex, wherein the elongated edge of the recessed region is located opposite the vertex, wherein the retention feature is selected from the group consisting of a rail and a narrow groove, wherein the hook engages the retention feature, wherein the threaded portion of the screw extends through the through-bore to engage the threaded receiving opening and removably affix the weight bar to the sole within the recessed region, and wherein W1 is greater than W2 and W3.

In some embodiments, the recessed region may comprise a swing surface, which may comprise a plurality of elongated structures extending from the vertex across the swing surface in a radial pattern, and the plurality of elongated structures may be selected from the group consisting of linear grooves and linear ridges. In further embodiments, the swing surface may have a constant radius and the weight bar may comprise a convex lower surface having a constant radius, or the weight bar may comprise a lower surface with at least one protrusion sized to contact at least one of the plurality of elongated structures during adjustment of the weight bar. In still other embodiments, W1 may be at least 1.5 times W2 or W3. In one embodiment, the receiving opening may be disposed proximate the vertex, which may be located at a center region of the sole between the heel side and the toe side.

In other embodiments, the second end of the weight bar may comprise a pointer, and the sole may comprise a plurality of adjustment indicia proximate the retention feature. In a further embodiment, each of the plurality of adjustment indicia may be aligned with one of the plurality of elongated structures. In still other embodiments, the golf club head may further comprise a slidable weight assembly, which may include an upper piece, a lower piece, and a mechanical fastener connecting the upper piece to the lower piece, the weight bar may comprise at least one rail, and the mechanical fastener may reversibly affix the slidable weight assembly to the at least one rail. In another embodiment, the head portion of the screw may comprise a first angled shoulder, the first end of the weight bar may comprise a second angled shoulder encircling the through-bore, and the first angled shoulder may press against the second angled shoulder when the screw is engaged with the through-bore and the threaded receiving opening to place the weight bar in compression between the screw and the wall. In a further embodiment, the second end may comprise a compressible feature. In any of the embodiments, the golf club head may further comprise a crown composed of a non-metal material, the body may comprise an upper opening sized to receive the crown, at least a portion of the triangular recessed region may be composed of a non-metal material, and a remainder of the body may be composed of a metal material. In a further embodiment, the non-metal material may be selected from the group consisting of carbon composite and plastic, and the metal material may be selected from the group consisting of titanium alloy and steel.

Another aspect of the present invention is a wood-type golf club head comprising a metal alloy body comprising a face, sole, heel side, toe side, upper opening, and rear side, a composite crown sized to close the upper opening, a weight bar comprising a central region having a first width W1, a first end having a through-bore and a second width W2, a second end having a third width W3, an engagement feature extending from the second end, a lower surface, and at least one protrusion extending from the lower surface, and a screw comprising a head portion and a threaded portion, wherein the sole comprises a recessed region, a threaded receiving opening within the recessed region, and a retention feature disposed along an elongated edge of the recessed region, wherein the recessed region is approximately triangular in shape and comprises a vertex and a swing surface, wherein the swing surface comprises a plurality of elongated structures selected from the group consisting of linear grooves and linear ridges extending from the vertex across the swing surface in a radial pattern, wherein the hook engages the retention feature, wherein the least one protrusion sized contacts at least one of the plurality of elongated structures during adjustment of the weight bar, wherein the threaded portion of the screw extends through the through-bore to engage the threaded receiving opening and removably affix the weight bar to the sole within the recessed region, wherein the weight bar is placed in tension or in compression when the screw is engaged with the threaded receiving opening, and wherein W1 is greater than W2 or W3.

In some embodiments, W1 may be at least 1.5 times W2 or W3. In other embodiments, the engagement feature may be a hook and the retention feature may be selected from the group consisting of a rail and a narrow groove. In still other embodiments, the recessed region may comprise an outer surface having a constant radius, and the lower surface of the weight bar may be convex and have a constant radius. In some embodiments, the head portion of the screw may comprise a first angled shoulder, the first end of the weight bar may comprise a second angled shoulder encircling the through-bore, and the first angled shoulder may press against the second angled shoulder when the screw is engaged with the through-bore and the threaded receiving opening. In any of the embodiments, the golf club head may be selected from the group consisting of an iron-type head, a wood-type head, a putter-type head, and a hybrid-type head.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

The design approaches described herein are based on a construction used in a driver head characterized by a composite crown 18 adhesively bonded to a cast titanium alloy or steel body 19. This particular construction approach permits the crown 18 configuration to be adapted to the inventive weighting scheme with minimal impact on weight and function. However, the weighting embodiments disclosed herein can be used with other constructions, including all metal, all composite, and a composite body with metal face cup. The weighting embodiments disclosed herein will also work in conjunction with at least one adjustable weight port on the crown of the driver head, and can also be used in connection with other types of golf club heads, including putters, irons, and hybrids.

Figure 1:
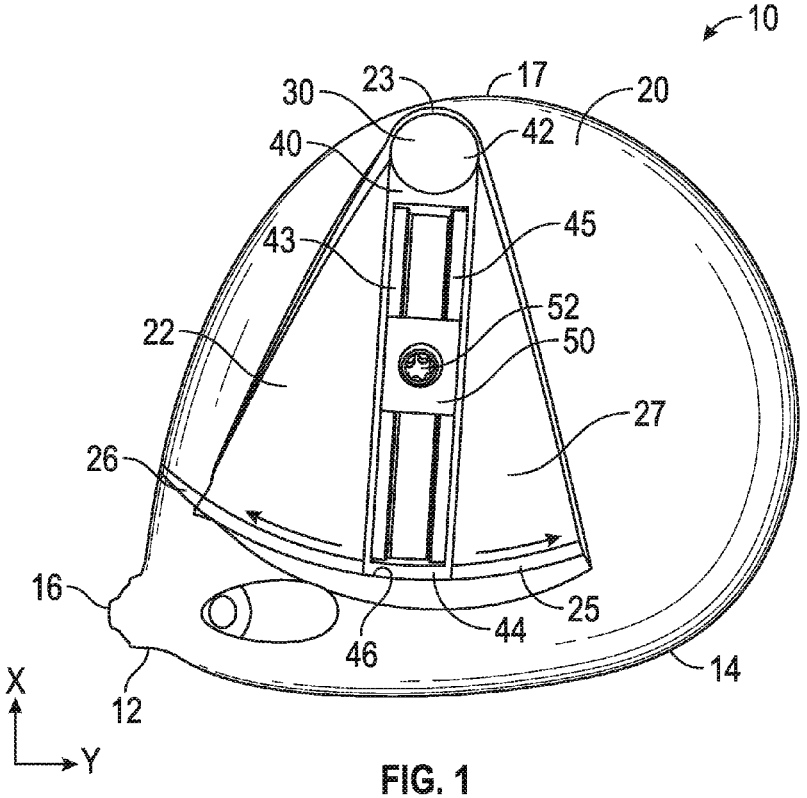
FIG. 1 is a sole elevational view of a golf club head encompassing a first embodiment of the present invention.
Figure 2:
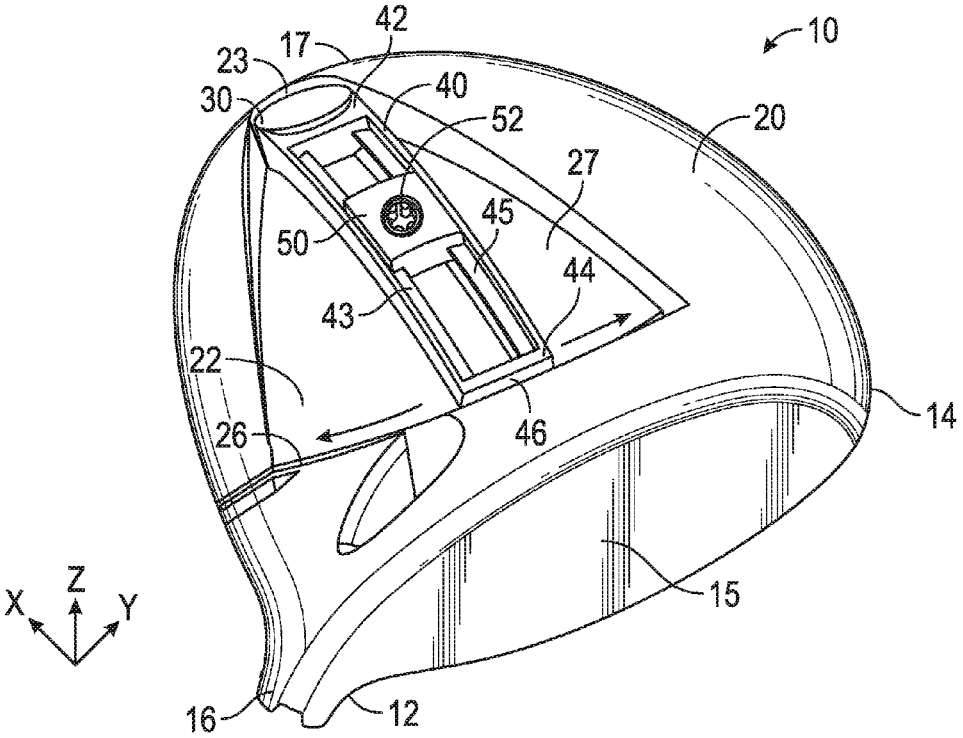
FIG. 2 is a sole perspective view of the embodiment shown in FIG. 1.

A first embodiment of the present invention is shown in FIGS. 1-2. The golf club head 10 comprises a body 19 having a heel 12, a toe 14, a face 15, a hosel 16, a rear side 17, and a sole 20, and also includes a crown 18. The sole 20 comprises a triangular recessed region 22 located at least 0.25 inch away from the face 15. The recessed region 22 has a receiving opening 24 disposed at its vertex 23 proximate the rear side 17 of the golf club head 10, and an elongated, narrow groove 26 disposed along the edge 25 of the recessed region 22 opposite the vertex 23 and proximate the face 15.

The golf club head also includes a rectangular weight bar 40 having a first end 42, a second end 44, and a pair of rails 43, 45 that are reversibly gripped by a slidable weight 50, which preferably has a two-piece structure with an upper portion 54 and a lower portion 56 that clamp the rails 43, 45 between them when a mechanical fastener 52 such as a bolt connecting the two pieces is tightened. The receiving opening 24 in the recessed region 22 is sized to receive a connection element 30 such as a plug, bolt, weight screw, cartridge, or other structural feature, which fixes the first end 42 of the weight bar 40 to the sole 20. The connection element 30 may be composed of a lightweight material, but preferably is composed of a high density material to act as a weighting element and move the center of gravity away from the face 15. The second end 44 of the weight bar 40 comprises a hook 46 that is sized to fit within, and slide along, the narrow groove 26 disposed proximate the face 15.

Figure 3:
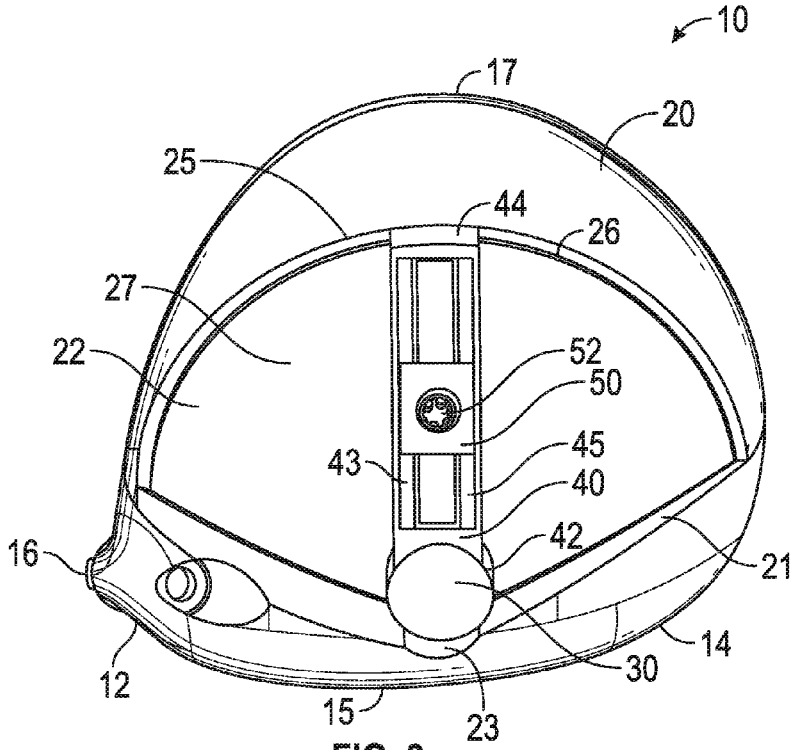
FIG. 3 is a sole elevational view of a second embodiment of the present invention.
Figure 4:
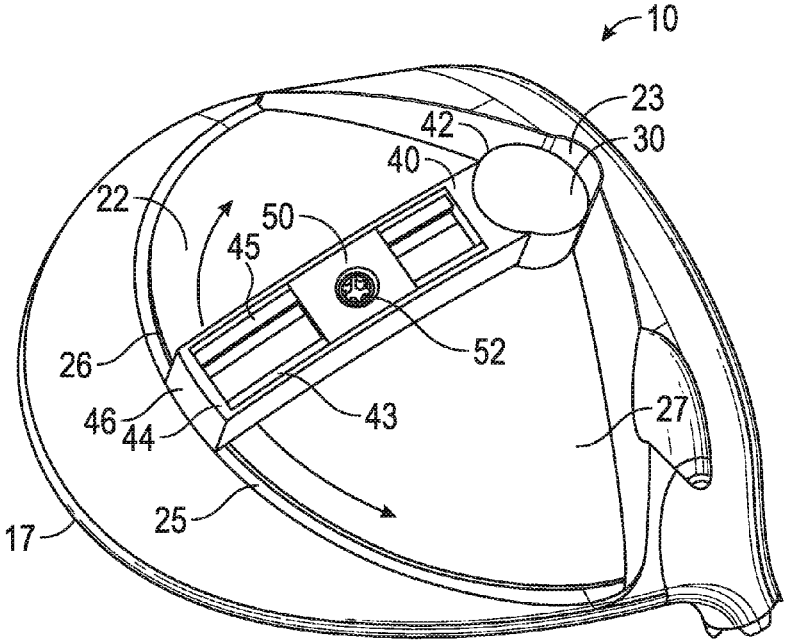
FIG. 4 is a sole perspective view of the embodiment shown in FIG. 3.

A second embodiment of the present invention is shown in FIGS. 3-4. In this embodiment, the golf club head 10 has all of the same features as the first embodiment, except that the vertex 23 of the triangular recessed region 22, and therefore the receiving opening 24 and the connection element 30, is disposed proximate the face 15 at a center 21 of the sole 20 between the heel 12 and the toe 14, while the edge 25 of the recessed region 22 opposite the vertex 23, and therefore the narrow groove 26, extends in an arc across the sole 20 from the heel 12 to the toe 14, approaching the rear side 17 at its midpoint. In a third, similar embodiment, shown in FIGS. 5-6, the vertex 23 is offset away from the center 21 towards the toe 14 of the golf club head 10 and the recessed region 22 does not cover as much of the sole 20 as in the second embodiment. In an alternative embodiment, the vertex 23 may be offset away from the center 21 towards the heel 12.

In a fourth embodiment, shown in FIGS. 7-11, the golf club head 10 has many of the features included in the first embodiment, with a threaded receiving opening 24 disposed at the vertex 23 of the recessed region 22 and a weight screw 60 having a threaded portion 62 sized to extend through an opening 47 in the first end 42 of the weight bar 40 and fit within the threaded receiving opening 24. The fourth embodiment differs from the other embodiments in that the wall 29 defining the edge 25 of the recessed region opposite the vertex 23 has an elongated concavity 28 extending along its surface in a heel to toe direction, and the second end 44 of the weight bar 40 is removably fixed to the edge 25 of the triangular recessed region 22 opposite the vertex 23 via a detent structure located inside the elongated concavity 28 instead of the hook 46 and narrow groove 26 structures disclosed in the first embodiment.

Figure 7:
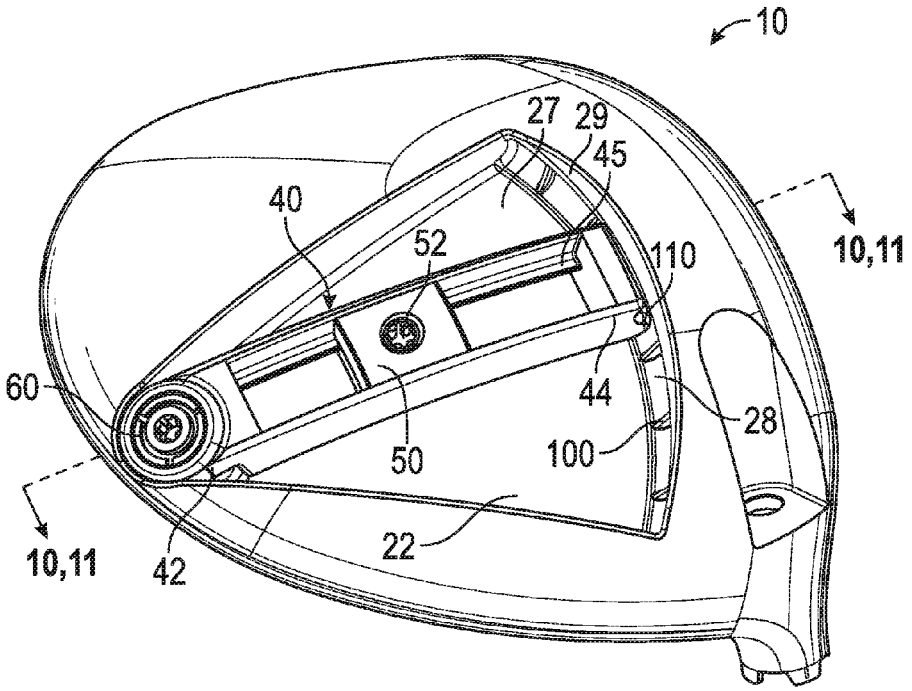
FIG. 7 is a sole perspective view of a fourth embodiment of the present invention.
Figure 8:
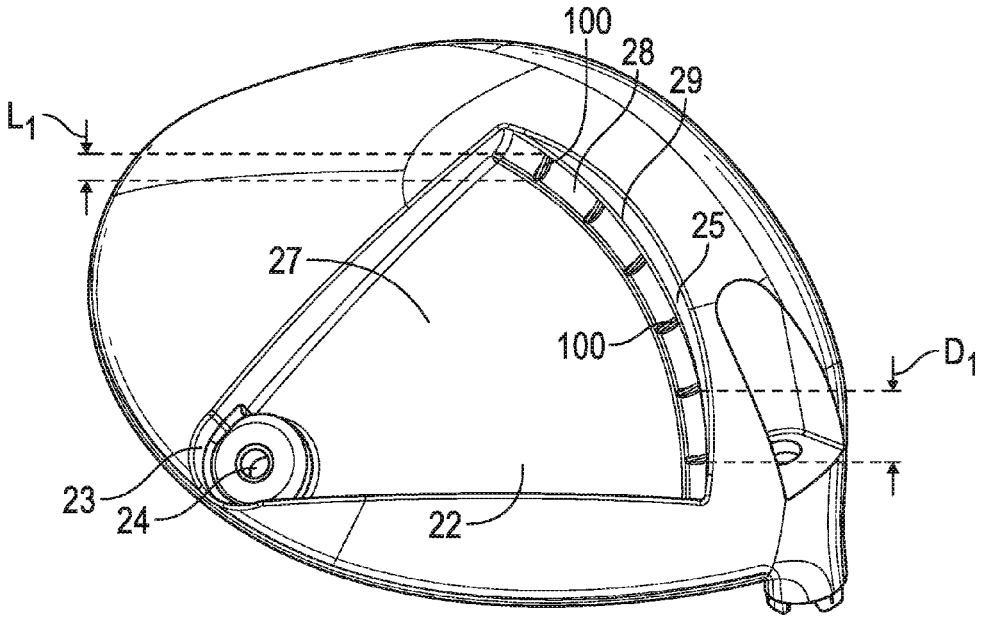
FIG. 8 is a sole perspective view of the embodiment shown in FIG. 7 without the weight bar.
Figure 9:
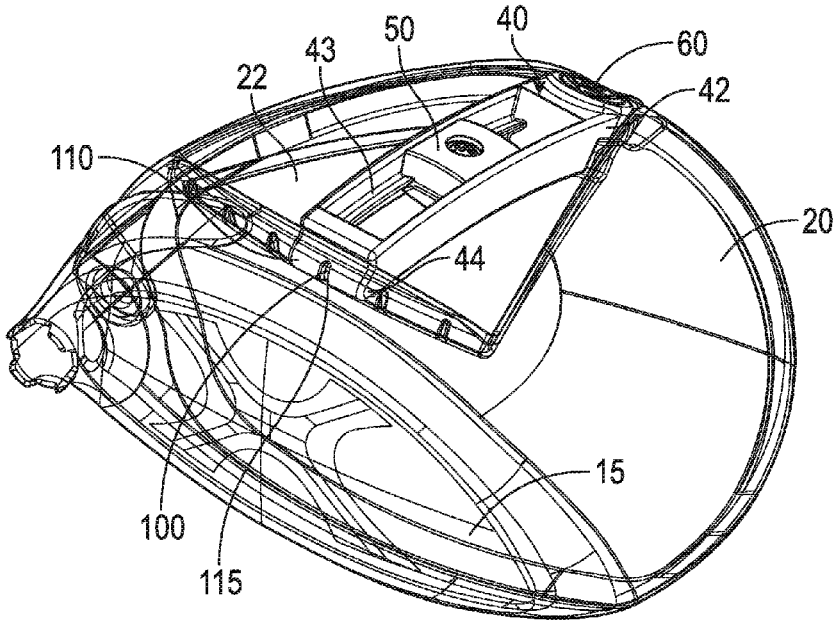
FIG. 9 is a sole perspective view of the embodiment shown in FIG. 7 with the golf club head in wire-frame view.

As shown in FIGS. 7-9, a plurality of vertical detents 100 are disposed along the edge 25 of the recessed region 22 opposite the vertex 23, each detent 100 spaced a distance $D_1$ from neighboring detents 100 and contained within the elongated concavity 28. The spacing $D_1$ between each pair of detents 100 preferably is the same and $D_1$ preferably is at least 0.10 inch. Each detent 100 has a vertical length $L_1$ that is less than the depth $L_2$ of the recessed region 22 proximate its opposite edge 25. The second end 44 of the weight bar 40, which preferably is co-molded or coated with a high-friction material such as rubber, comprises a rounded protrusion 110 having a vertical groove 115 sized to receive each detent 100, and has a width that is less than twice the distance $D_1$.

Figure 10:
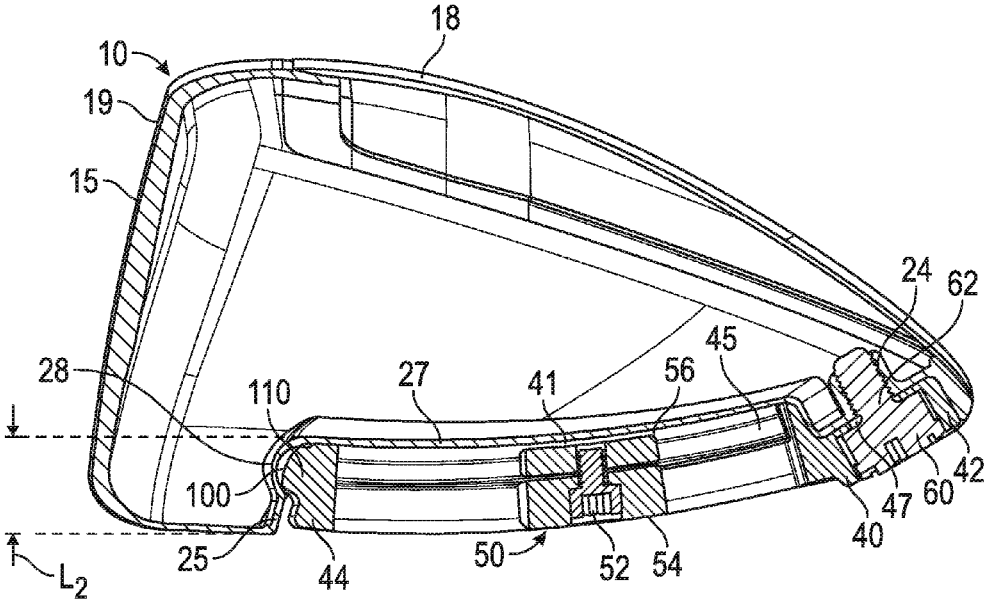
FIG. 10 is a cross-sectional view of the embodiment shown in FIG. 7 along lines 10-10.
Figure 11:
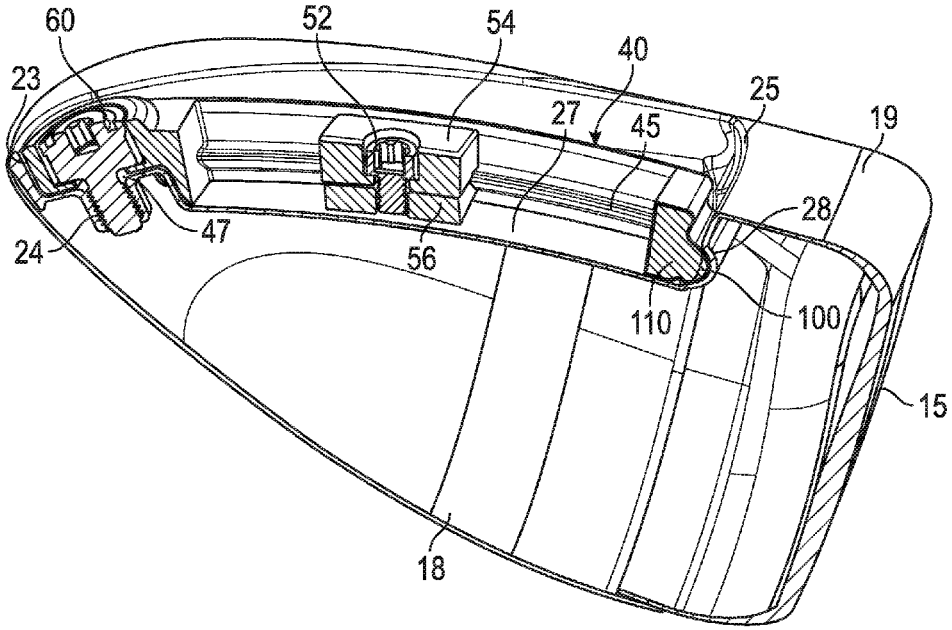
FIG. 11 is a side perspective view of the cross-section shown in FIG. 10.

When a user wishes to attach the weight bar 40 to the golf club head 10, he inserts a detent 100 at the selected location along the wall 29 into the vertical groove 115 such that the rounded protrusion 110 is disposed within the elongated concavity 28, as shown in FIGS. 10 and 11. This reversibly locks the second end 44 of the weight bar 40 to the sole 20. He then positions the opening 47 in the first end 42 of the weight bar 40 over the threaded receiving opening 24 in the sole 20 and screws the threaded portion 62 of the weight screw 60 into the threaded receiving opening 24. This tightly, but reversibly, locks the first end 42 of the weight bar 40 to the sole 20. If the second end 44 of the weight bar 40 is coated with a polymeric material such as rubber or plastic, the rounded protrusion 110 on the second end 44 can be interference fit within the elongated concavity 28 when the coating is compressed. The coating can also reduce vibrations emanating from the weight bar 40 when the golf club head 10 is in use.

Figure 12:
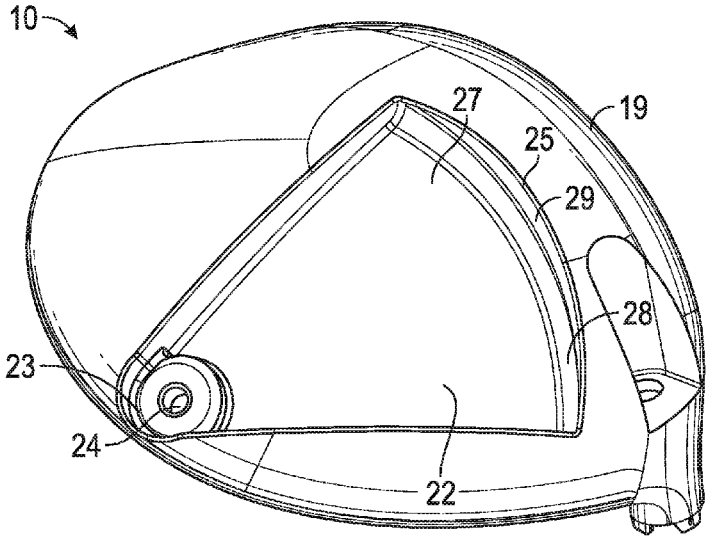
FIG. 12 is a sole perspective view of a fifth embodiment of the present invention.
Figure 13:
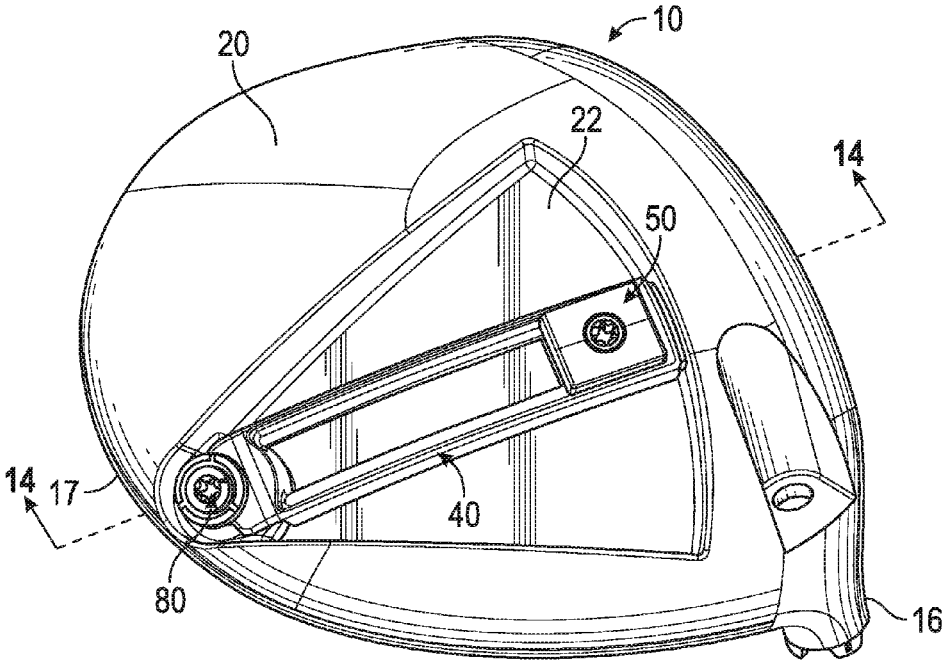
FIG. 13 is a sole perspective view of a sixth embodiment of the present invention.
Figure 14:
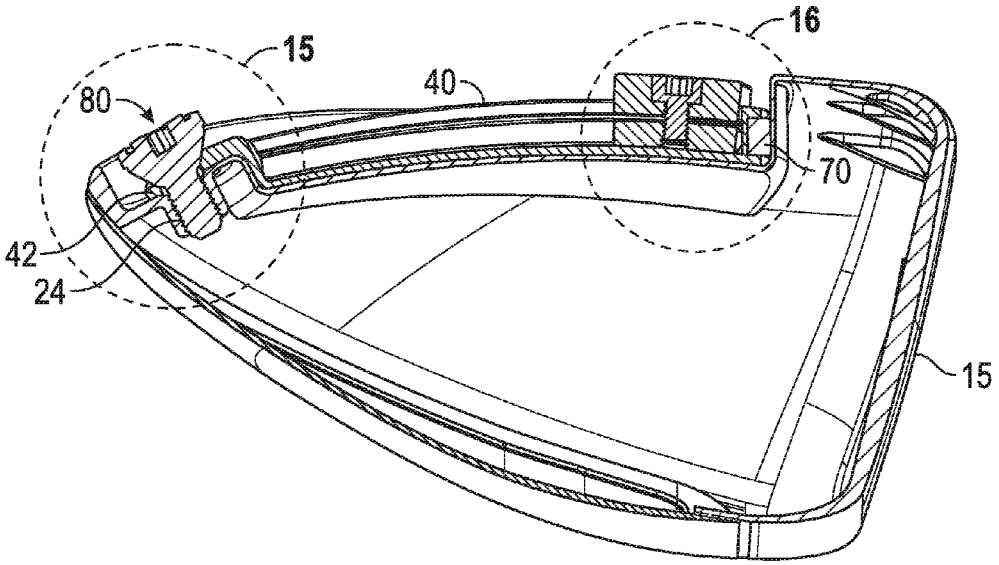
FIG. 14 is a cross-sectional view of the embodiment shown in FIG. 13 along lines 14-14.
Figure 15:
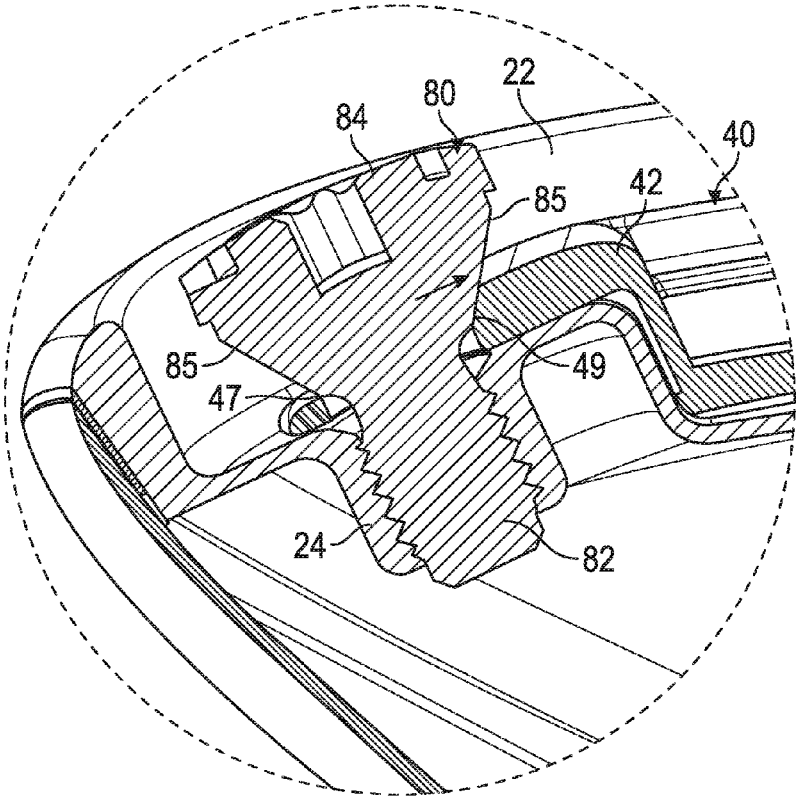
FIG. 15 is an enlarged view of the circled portion of the embodiment shown in FIG. 14.
Figure 16:
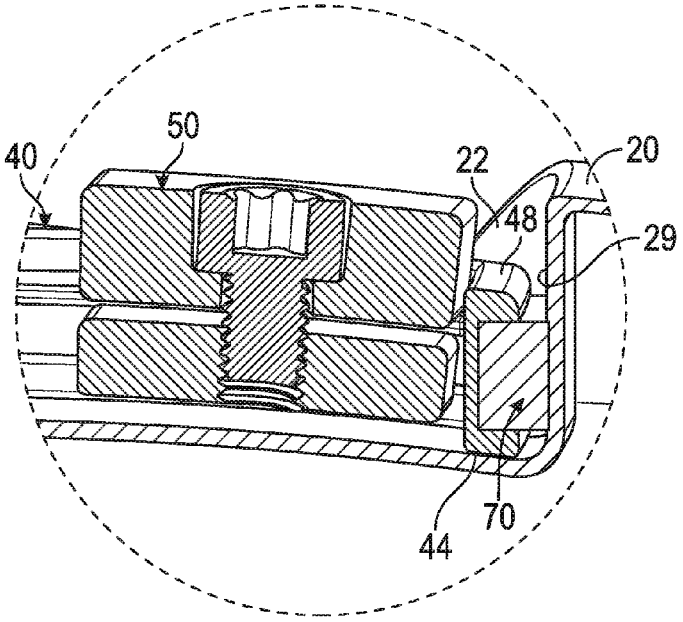
FIG. 16 is an enlarged view of the circled portion of the embodiment shown in FIG. 14.
Figure 17:
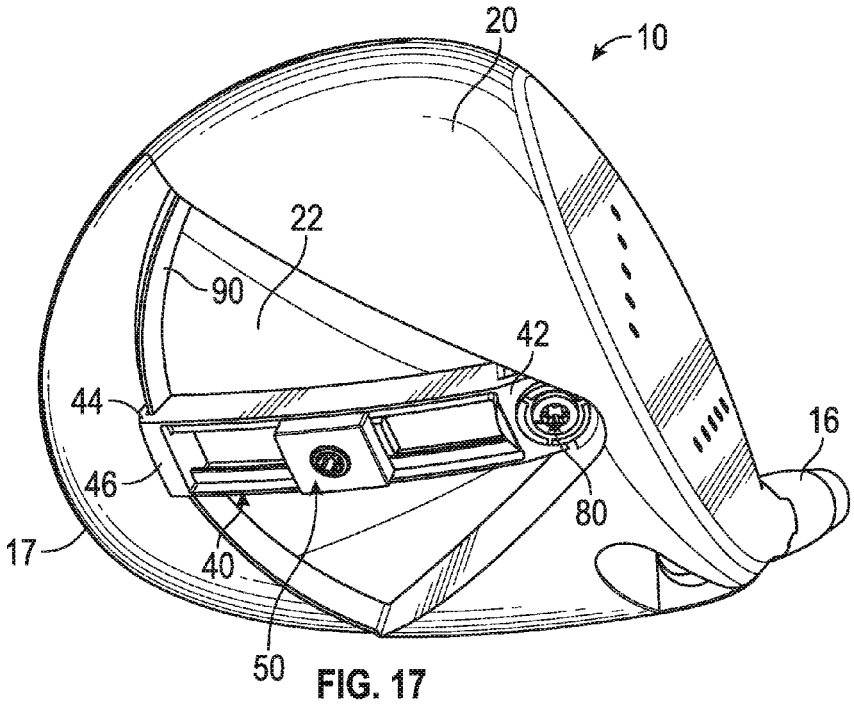
FIG. 17 is a side perspective view of a seventh embodiment of the present invention.
Figure 18:
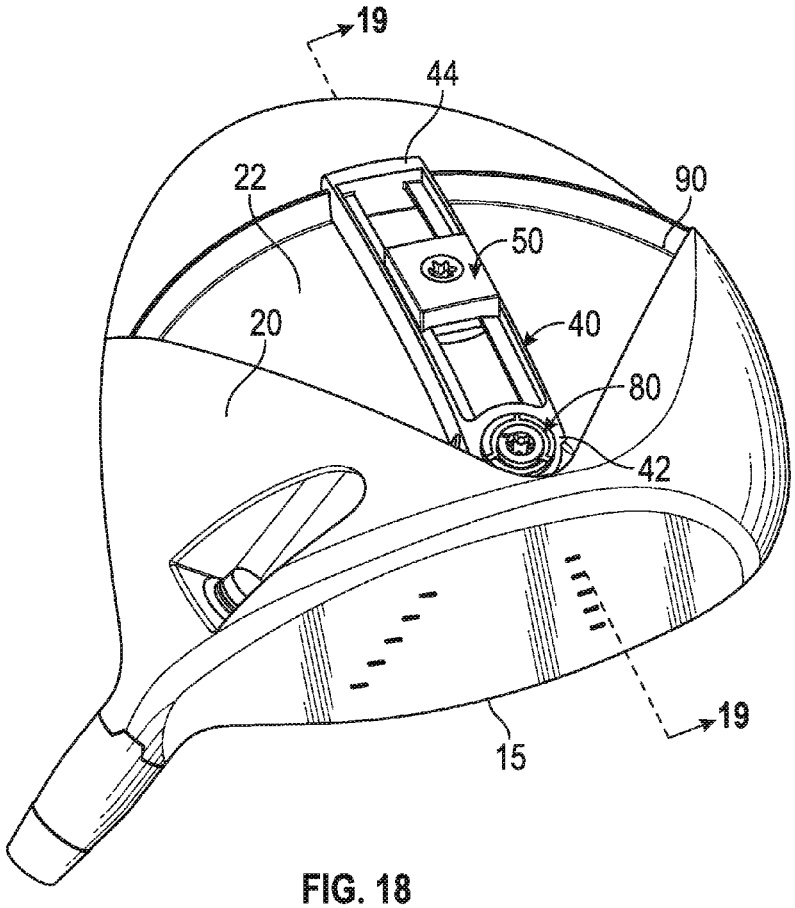
FIG. 18 is a sole perspective view of the embodiment shown in FIG. 17.
Figure 19:
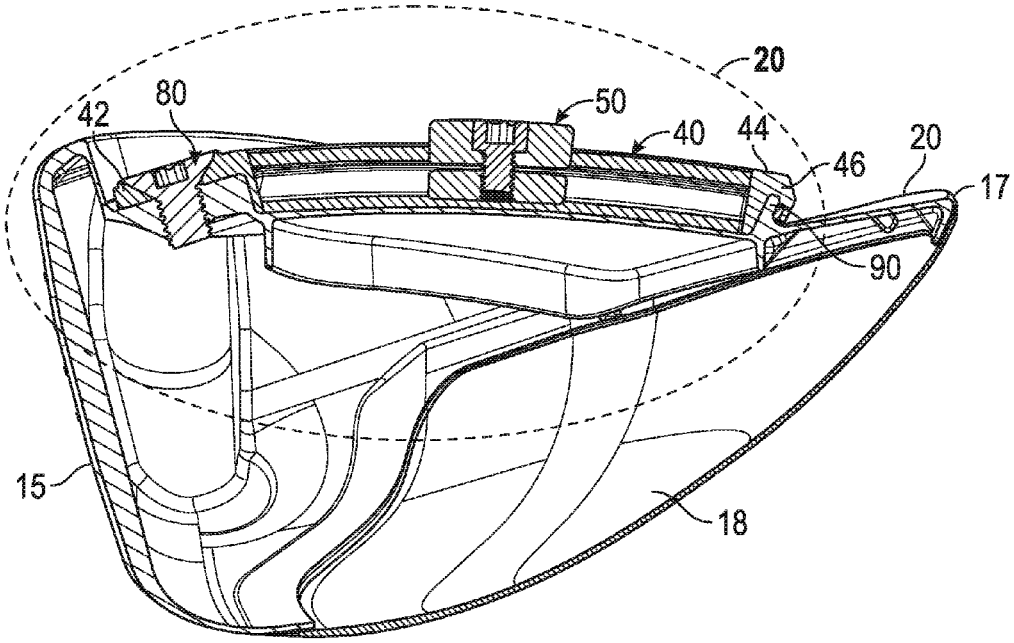
FIG. 19 is a cross-sectional view of the embodiment shown in FIG. 18 along lines 19-19.
Figure 20:
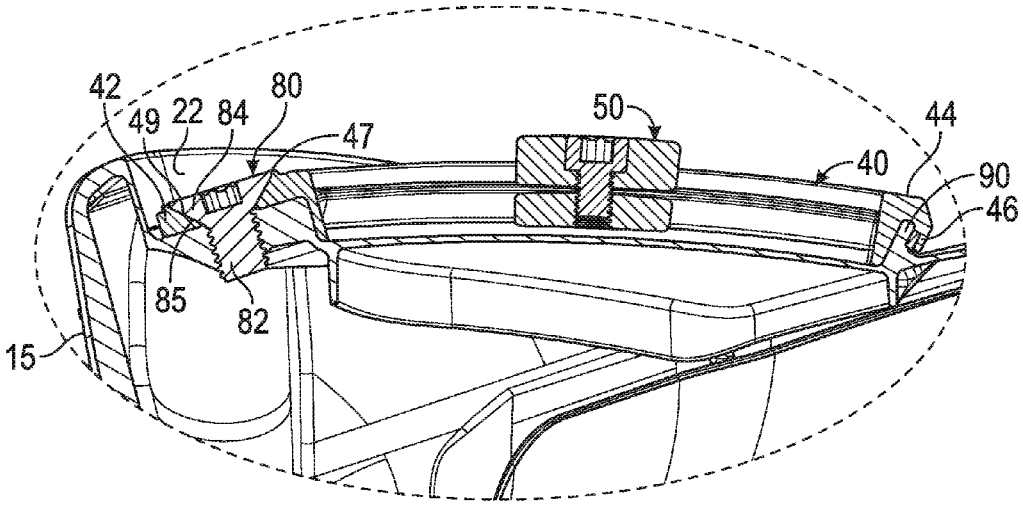
FIG. 20 is an enlarged view of the circled portion of the embodiment shown in FIG. 19.
Figure 21:
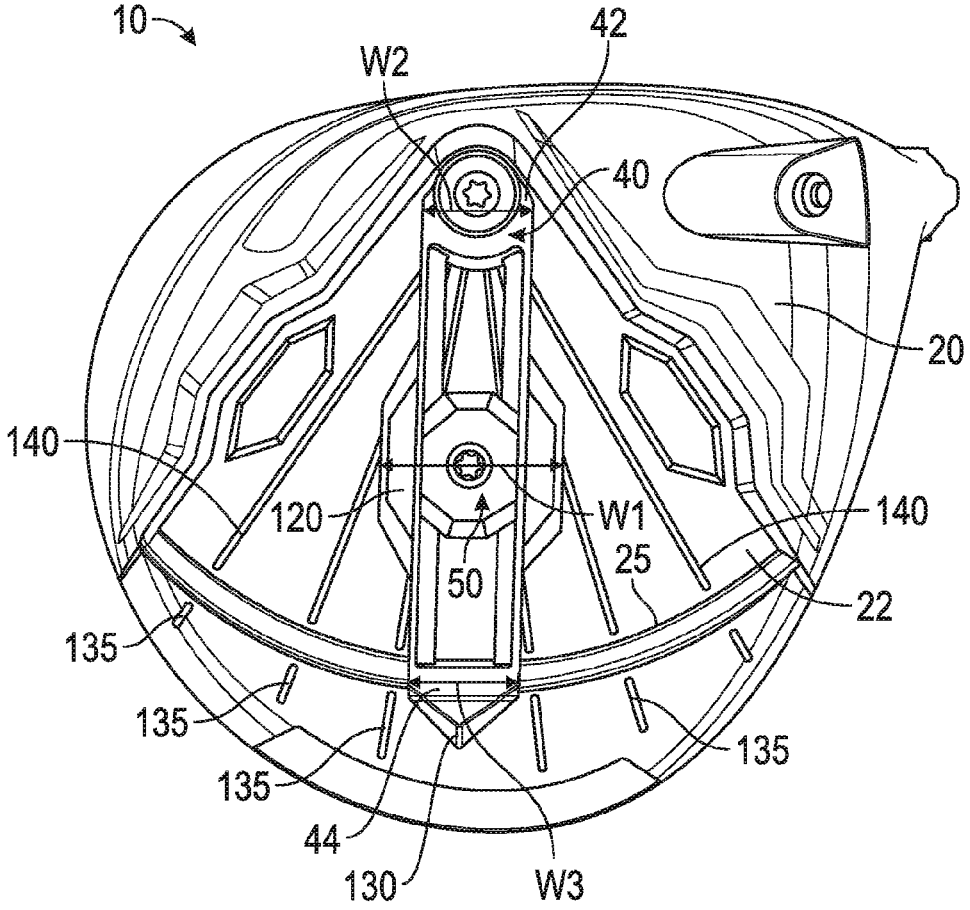
FIG. 21 is a sole elevational view of an eighth embodiment of the present invention.

In a fifth embodiment, shown in FIG. 12, the golf club head 10 has all of the features of the third embodiment except for the detents 100 and the vertical groove 115. In this embodiment, the rounded protrusion 110 on the second end 44 of the weight bar 40 is coated with a compressible, high-friction material such as rubber and can be interference fit at any location within the elongated concavity 28. When the first end 42 of the weight bar 40 is secured to the recessed region with the weight screw 60, the high-friction material expands within the elongated concavity 28 and prevents the second end 44 from moving in any direction therein. This embodiment provides a user with a greater number of adjustment options along the heel-to-toe Y axis because the user is not limited to using the fixed number of locations set by the detents 100.

In a sixth embodiment similar to the one shown in FIG. 12, the golf club head has all of the features of the fifth embodiment except that the second end 44 of the weight bar does not include a rounded protrusion 110, but instead comprises a clip feature 48 that grips a bumper 70 composed of a resilient, compressible material such as rubber, and the weight screw 80 has a head portion 84 with an angled shoulder 85 designed to put pressure on the weight bar 40. When the weight bar 40 is disposed in a location in the recessed region 22 desired by the golfer, he or she inserts the threaded portion 82 of the weight screw 80 into the opening 47 in the first end 42 of the weight bar 40 so that it engages with the threaded receiving opening 24. In doing so, the angled shoulder 85 of the weight screw 80 presses against an angled edge 49 of the opening 47, which then presses the weight bar 40 against the wall 29 at the edge 25 of the recessed region 22 and compresses the bumper 70 against the wall 29. In this way, the weight bar 40 is placed in compression within the recessed region 22 and secured at both ends 42, 44 by the weight screw 80 and the bumper 70, respectively.

In a seventh embodiment, shown in FIGS. 17-20, the weight bar 40 is placed in tension in the recessed region 22. In this embodiment, the recessed region 22 is not bounded by a wall 29 as in the other embodiments, but instead is separated from the rear side 17 of the golf club head 10 by a rail 90 that extends away from the sole 20 and arcs from the heel 12 side of the recessed region 22 to the toe 14 side. The second end 44 of the weight bar 40 comprises a hook 46 sized to fit over and grip the rail 90. As with the sixth embodiment, the weight screw 80 comprises an angled shoulder 85 that, when the weight screw 80 is engaged with the threaded receiving opening 24 through the opening 47 in the weight bar 40, presses against the angled edge 49 of the opening 47, which in this embodiment is located on the face 15 side of the golf club head 10. In doing so, the weight screw 80 pulls the weight bar 40 towards the face 15, causing the hook 46 to reversibly lock to the rail 90, and placing the weight bar 40 in tension in the recessed region 22. This concept can also be applied to the first embodiment, which employs a narrow groove 26 along the edge 25 of the recessed region 22, by using the weight screw 80 and weight bar 40 of the seventh embodiment.

In each of the embodiments disclosed herein, the recessed region 22 preferably comprises a swing surface 27 having a constant radius to allow for smooth movement of the weight bar 40 during adjustment. The weight bar 40 preferably comprises a concave lower surface 41 with a radius that matches the curvature of the swing surface 27 so that the weight bar 40 mates with the swing surface 27 no matter how it is oriented within the recessed region 22. In any of the embodiments disclosed herein, the recessed region 22 may be formed separately from, and bonded, welded, or otherwise permanently affixed to, the body 19, which may have a triangular opening sized to receive the recessed region. In this embodiment, the recessed region 22 can be composed of a lightweight material such as composite or plastic, and may be translucent or transparent so that the interior of the golf club head 10 is at least partially visible to the user.

Figure 5:
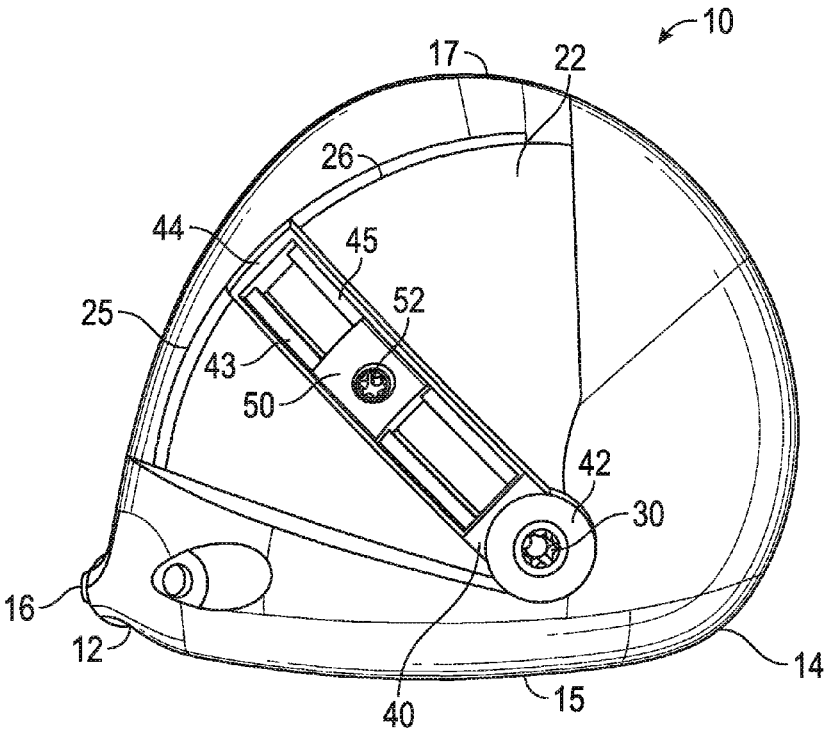
FIG. 5 is a sole elevational view of a third embodiment of the present invention.
Figure 6:
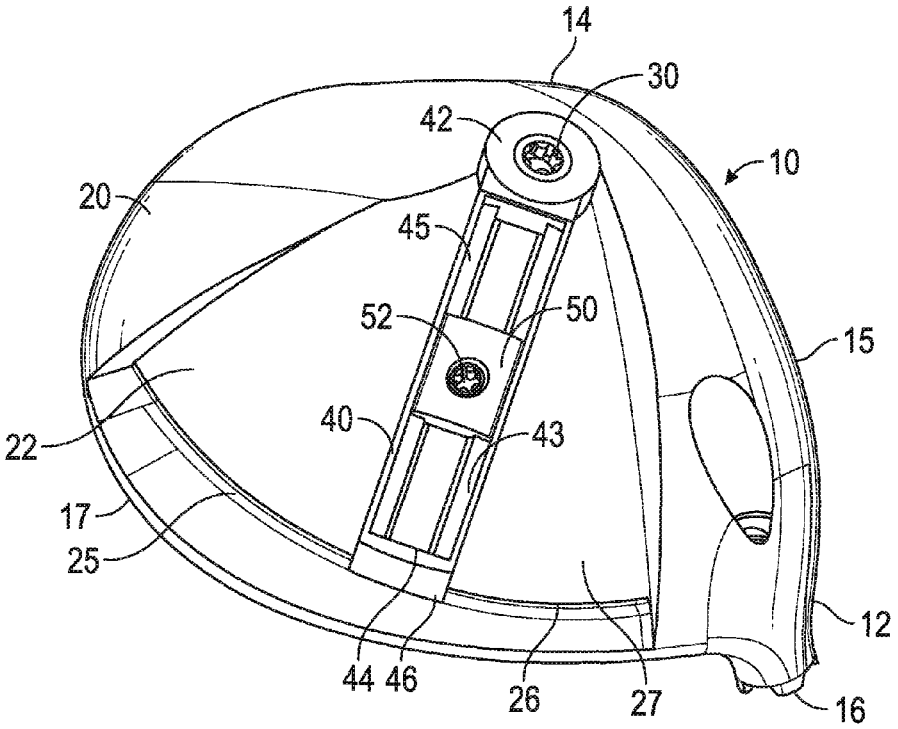
FIG. 6 is sole perspective view of the embodiment shown in FIG. 5.

Each of the embodiments of the present invention disclosed herein allows for adjustment of multiple characteristics of the golf club head 10. As shown in the Figures, when the connection element 30 or weight screw 60, 80 is loosened, such that it is not fixing the first end 42 of the weight bar 40 to the sole 20, the weight bar 40 is free to be rotated around the vertex 23 by sliding the second end 44 along the recessed region 22 (and the hook 46 within the narrow groove 26 or on the rail 90, for the first three and sixth embodiments) towards the heel 12 or toe 14 regions of the golf club head 10. Adjusting the weight bar 40 in this manner allows for horizontal adjustment of the golf club's center of gravity location along the horizontal Y axis, and also affects face angle. For example, moving the weight bar 40 towards the toe 14 creates a fade effect, moving the weight bar towards the heel 12, as shown in FIGS. 5-6, creates a draw effect, and centering the weight bar 40 such that it is disposed approximately perpendicular to the face 15, as shown in FIGS. 1-4, 7, 9-11, and 13-22 creates a neutral effect.

The center of gravity location can also be adjusted along the X axis by moving the slidable weight 50 to different points along the weight bar 40. And the center of gravity location can be adjusted along the vertical (crown 18 to sole 20) Z axis by changing the mass or material composition of one or more pieces of the slidable weight 50 engaged with the weight bar 40, or the mass or material composition of the weight bar 40 itself.

The adjustability of the golf club head 10 of the present invention is further enhanced by the fact that weight bars 40 can be replaced with other weight bars 40 having different shapes and/or functionality. For example, the weight bar 40 shown in FIG. 21 has a central region 120 between the first and second ends 42, 44 with a width W1 that is greater than the widths W2, W3 of the first and second ends 42, 44, and preferably at least 1.5 times the width of W2 or W3. This increased width W1 concentrates mass at the center of the weight bar 40, and thus the center of the golf club head 10, and causes the overall center of gravity of the golf club head 10 to move downwards along the Z axis towards the sole 20. The weight bar 40 shown in FIG. 21 also includes a pointer 130 at the tip of its second end 44, which can help a golfer with precise adjustments of the weight bar 40, especially if the recessed region 22 comprises adjustment indicia 135 proximate its edge 25 to suggest optimal positions for different performance characteristics. In the embodiment shown in FIG. 21, the recessed region 22 comprises a plurality of grooves 140 radiating outward from the vertex 23, which extend to the edge 25 of the recessed region 22 and align with grooved adjustment indicia 135. The weight bar 40 may include a flexible protrusion 125 or other structural feature extending from its lower surface 41 to engage the grooves 140, and thereby provide audible and/or frictional signals to a user when the weight bar 40 passes over one of the grooves 140 or an adjustment has been achieved.

Figure 22:
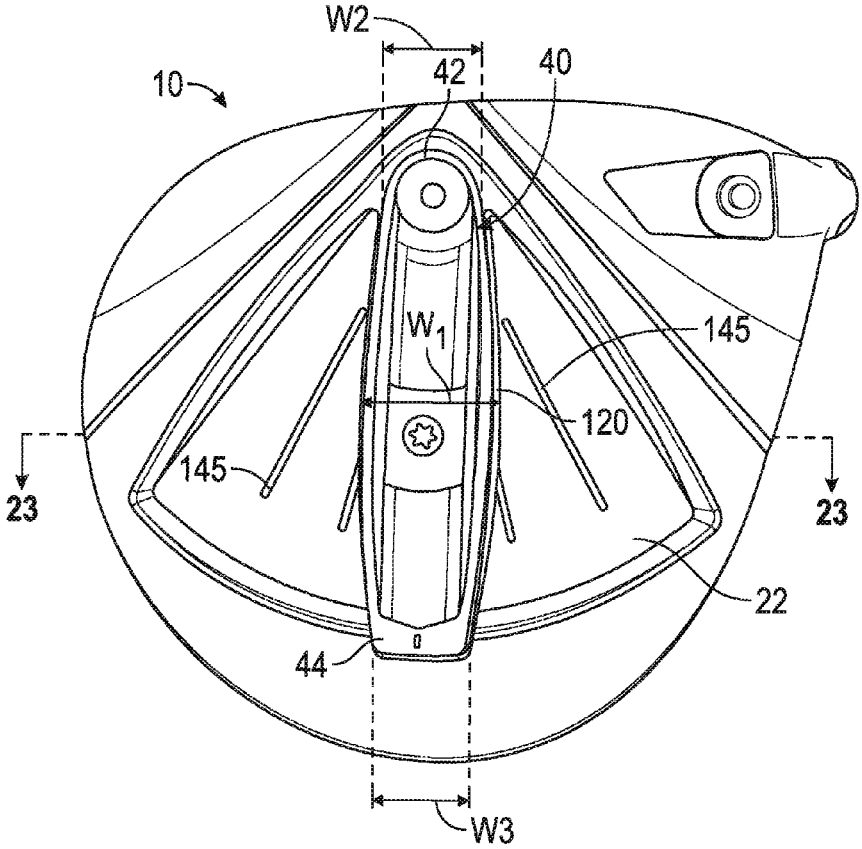
FIG. 22 is a sole elevational view of a ninth embodiment of the present invention.
Figure 23:
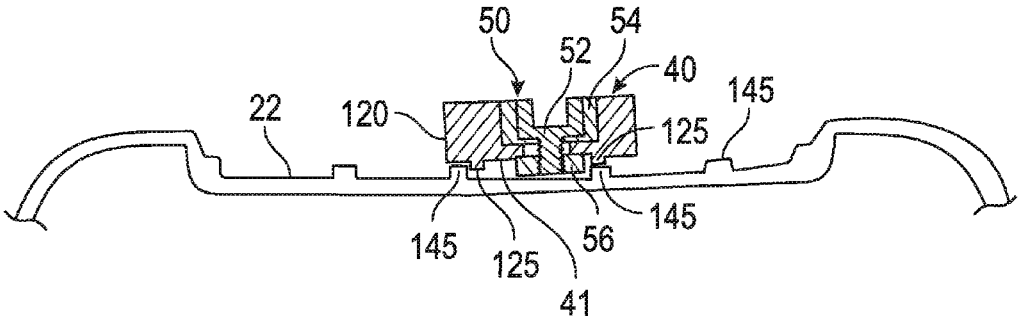
FIG. 23 is a cross-sectional view of the embodiment shown in FIG. 22 along lines 23-23.

Another exemplary, alternative weight bar 40 is shown in FIGS. 22-23. In this embodiment, the weight bar 40 increases in width from both the first and second ends 42, 44, such that the weight bar has an approximately oval shape, with a maximum width W1 at its central region 120. The recessed region 22 in this embodiment includes a plurality of ridges 145 extending from the swing surface 27, and the lower surface 41 of the weight bar 40 includes a flexible protrusion 125 that engages the ridges 145 during adjustment of the weight bar 40 and thereby provides audible and/or frictional signals to a user that an adjustment has been achieved. In any of these embodiments, the flexible protrusion 125 may be made from an elastic polymeric material.

In any of the embodiments disclosed herein, the connection element 30 or weight screw 60, 80 may have a ratcheting feature, such as the one disclosed in U.S. Pat. No. 8,801,537, the disclosure of which is incorporated by reference in its entirety herein. In this way, when the connection element 30 or weight screw 60, 80 is loosened but still is partially retained within the receiving opening 24, rotating the weight bar 40 around the vertex 23 will cause the ratcheting feature to provide audible signals to a user when an adjustment has been achieved. The ratcheting feature can also provide incremental adjustment points for the weight bar 40, especially if the golf club head 10 does not include any detents 100.

The weight bar 40 may have any of the features disclosed in U.S. Pat. Nos. 8,790,195, 8,968,116, 9,220,957, and 9,259,627 and U.S. patent application Ser. No. 14/755,068, the disclosure of each of which is incorporated by reference in its entirety herein. The slidable weight 50, and the features of the weight bar 40 to which it attaches, may have any of the features disclosed in U.S. Pat. Nos. 8,696,491, 8,894,506, 9,084,921, and 9,211,453 and U.S. patent application Ser. Nos. 14/174,068, 14/175,657, 14/216,971, 14/933,973, 15/012,493, and 15/018,040, the disclosure of each of which is incorporated by reference in its entirety herein.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim:

1. A golf club head comprising:

a body comprising a face, sole, heel side, toe side, and rear side;

a weight bar comprising a central region having a first width W1, a first end having a through-bore and a second width W2, a second end having a third width W3, and a hook extending from the second end; and a screw comprising a head portion and a threaded portion, wherein the sole comprises a recessed region, a threaded receiving opening within the recessed region, and a retention feature disposed along an elongated edge of the recessed region, wherein the retention feature is selected from the group consisting of a rail and a narrow groove, wherein the hook engages the retention feature, wherein the threaded portion of the screw extends through the through-bore to engage the threaded receiving opening and removably affix the weight bar to the sole within the recessed region, and wherein W1 is greater than W2 and W3.

2. The golf club head of claim 1, wherein the recessed region comprises a swing surface, wherein the swing surface comprises a plurality of elongated structures extending across the swing surface in a radial pattern, and wherein the plurality of elongated structures is selected from the group consisting of linear grooves and linear ridges.

3. The golf club head of claim 2, wherein the swing surface has a constant radius, and wherein the weight bar comprises a convex lower surface having a constant radius.

4. The golf club head of claim 2, wherein the weight bar comprises a lower surface, and wherein the lower surface comprises at least one protrusion sized to contact at least one of the plurality of elongated structures during adjustment of the weight bar.

5. The golf club head of claim 1, wherein W1 is at least 1.5 times W2 or W3.

6. The golf club head of claim 1, wherein the receiving opening is disposed at a center region of the sole between the heel side and the toe side.

7. The golf club head of claim 1, wherein the second end comprises a pointer, and wherein the sole comprises a plurality of adjustment indicia proximate the retention feature.

8. The golf club head of claim 7, wherein each of the plurality of adjustment indicia is aligned with one of the plurality of elongated structures.

9. The golf club head of claim 1, further comprising a slidable weight assembly, wherein the slidable weight assembly comprises an upper piece, a lower piece, and a mechanical fastener connecting the upper piece to the lower piece, wherein the weight bar comprises at least one rail, and wherein the mechanical fastener reversibly affixes the slidable weight assembly to the at least one rail.

10. The golf club head of claim 1, wherein the head portion of the screw comprises a first angled shoulder, wherein the first end comprises a second angled shoulder encircling the through-bore, and wherein the first angled shoulder presses against the second angled shoulder when the screw is engaged with the through-bore and the threaded receiving opening to place the weight bar in compression between the screw and the retention feature.

11. The golf club head of claim 10, wherein the second end comprises a compressible feature.

12. The golf club head of claim 1, further comprising a crown composed of a non-metal material, and wherein the body comprises an upper opening sized to receive the crown.

13. The golf club head of claim 1, wherein at least a portion of the recessed region is composed of a non-metal material, and wherein a remainder of the body is composed of a metal material.

14. The golf club head of claim 13, wherein the non-metal material is selected from the group consisting of carbon composite and plastic, and wherein the metal material is selected from the group consisting of titanium alloy and steel.

15. A wood-type golf club head comprising:

a metal alloy body comprising a face, sole, heel side, toe side, upper opening, and rear side;

a composite crown sized to close the upper opening;

a weight bar comprising a central region having a first width W1, a first end having a through-bore and a second width W2, a second end having a third width W3, an engagement feature extending from the second end, a lower surface, and at least one protrusion extending from the lower surface; and a screw comprising a head portion and a threaded portion, wherein the sole comprises a recessed region, a threaded receiving opening within the recessed region, and a retention feature disposed along an elongated edge of the recessed region, wherein the recessed region comprises a swing surface, wherein the swing surface comprises a plurality of elongated structures selected from the group consisting of linear grooves and linear ridges extending across the swing surface, wherein the hook engages the retention feature, wherein the least one protrusion contacts at least one of the plurality of elongated structures during adjustment of the weight bar, wherein the threaded portion of the screw extends through the through-bore to engage the threaded receiving opening and removably affix the weight bar to the sole within the recessed region, and wherein the weight bar is placed in tension or in compression when the screw is engaged with the threaded receiving opening.

16. The wood-type golf club head of claim 15, wherein W1 is greater than W2 or W3.

17. The wood-type golf club head of claim 16, wherein W1 is at least 1.5 times W2 or W3.

18. The wood-type golf club head of claim 15, wherein the engagement feature is a hook, and wherein the retention feature is selected from the group consisting of a rail and a narrow groove.

19. The wood-type golf club head of claim 15, wherein the recessed region comprises an outer surface having a constant radius, and wherein the lower surface of the weight bar is convex and has a constant radius.

20. The wood-type golf club head of claim 15, wherein the head portion comprises a first angled shoulder, wherein the first end comprises a second angled shoulder encircling the through-bore, and wherein the first angled shoulder presses against the second angled shoulder when the screw is engaged with the through-bore and the threaded receiving opening.

* * * * *